United States Patent [19]

Lisec

[11] Patent Number: 5,010,619

[45] Date of Patent: Apr. 30, 1991

[54] NOZZLE FOR DRYING SHEET GLASS

[76] Inventor: Peter Lisec, Bahnhofstrasse 34, A-3363 Amstetten-Hausmening, Austria

[21] Appl. No.: 496,952

[22] Filed: Mar. 20, 1990

[30] Foreign Application Priority Data

Apr. 11, 1989 [AT] Austria ..... 853/89

[51] Int. Cl.[5] ..... A47L 5/38; A47L 15/00

[52] U.S. Cl. ..... 15/307; 15/302; 15/306 R

[58] Field of Search ..... 15/307, 306.1, 309.2, 15/316.1

[56] References Cited

U.S. PATENT DOCUMENTS

| | | | |
|---|---|---|---|
| 2,671,241 | 3/1954 | Starner | 15/306 |
| 3,358,315 | 12/1967 | Bennett | 15/306.1 |
| 3,462,851 | 8/1969 | Urbas | 34/160 |
| 3,849,831 | 11/1974 | DeVerter et al. | 15/309.2 |

FOREIGN PATENT DOCUMENTS

| | | | |
|---|---|---|---|
| 0174294 | 3/1986 | European Pat. Off. . | |
| 0204063 | 12/1986 | European Pat. Off. . | |
| 0213532 | 3/1987 | European Pat. Off. . | |
| 1283159 | 6/1965 | Fed. Rep. of Germany . | |
| 3230247 | 2/1984 | Fed. Rep. of Germany . | |
| 3533085 | 3/1987 | Fed. Rep. of Germany . | |
| 169329 | 8/1934 | Switzerland | 15/307 |

*Primary Examiner*—Paul T. Sewell
*Assistant Examiner*—M. D. Patterson
*Attorney, Agent, or Firm*—Young & Thompson

[57] ABSTRACT

In the drying zone of a sheet glass washing machine, a pair of mutually opposed nozzles (10) is provided, the air outlet openings (11) of which face the glass sheet to be dried. At least one shutoff element (12) is associated with the air outlet opening (11) of each nozzle (10), this shutoff element, in its operative position, sealing off the top region of the air outlet opening (11). The shutoff element (12) extends over half the length of the air outlet opening (11) and has a cylindrical shutoff member (13) of an elastically yielding material which can be placed from the inside against the air outlet opening (11).

12 Claims, 2 Drawing Sheets

NOZZLE FOR DRYING SHEET GLASS

Figure 1:
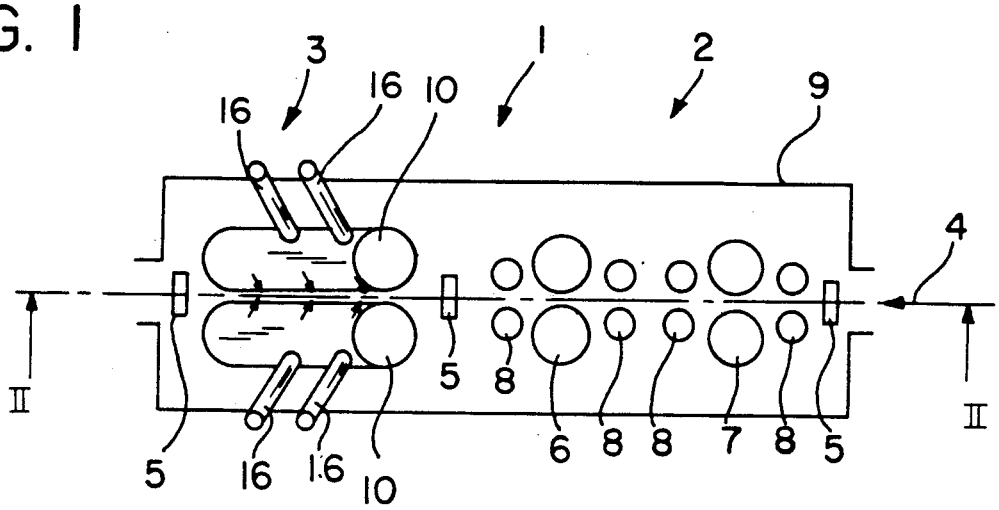

The invention relates to a nozzle for the drying zone of a sheet glass washing machine which extends optionally obliquely to the direction of travel of the glass sheet to be cleaned and/or dried in a plane in parallel to the plane of the glass sheet transversely to the direction of travel, the air outlet opening of this nozzle facing the glass sheet and forming therewith preferably an acute angle and being designed as a slot or as a series of orifices.

Such nozzles are conventional; in this connection, attention is invited, for example, to EP-A-0,213,532.

The conventional nozzles have the drawback that air is discharged from their air outlet openings, normally fashioned as a slot extending over the entire length of the nozzle, constantly over the entire air outlet cross section, i.e. over the entire height of the nozzle. Since the glass washing machines and also their drying zone are designed for processing the largest prevailing pane formats, the nozzles of the drying zone ordinarily have a longitudinal dimension of about 3 meters, measured transversely to the direction of travel of the glass sheets.

Since, on the other hand, 95% of the glass sheets to be cleaned and to be dried have a height of merely about 1.4–1.5 m, the air flows out of the air outlet opening of the nozzles unused in the region lying above the glass sheet to be dried.

The invention is based on the object of further developing a nozzle of the type discussed above in such a way that, without impairment of the drying effect, the useless efflux of air from the air outlet opening of the nozzle is avoided.

This object has been attained in accordance with this invention by associating with the air outlet opening of the nozzle at least one shutoff element which, in its operative position, seals off a region of the air outlet opening located at a distance from the conveying unit for the glass sheet in the region of the drying zone.

On account of the arrangement of this invention, the effective length of the air outlet opening, i.e. the region of the air outlet opening through which air actually exits, can be adapted to the actual height of the glass sheet to be dried.

Since primarily glass sheets having a height of 1.4 m to 1.5 m are to be dried after washing, before being passed on to insulating glass production, a preferred feature of the invention resides in providing the shutoff element over half the length of the air outlet opening.

In this embodiment, as well as in the embodiment according to claim 1, the shutoff element can be of continuous extension or it can be subdivided, a continuously extending shutoff element being preferred in the embodiment according to claim 2.

Especially in case subdivided shutoff elements are provided, but also in case of continuous shutoff elements, an embodiment of the invention is advantageous according to which a sensor is included which detects the height of the glass sheet to be dried and which transmits a corresponding signal to the control unit for the drive mechanism for the shutoff elements. In this way, the dimension of the air outlet opening is automatically adapted to the dimension of the glass sheet to be dried so that air losses and useless blower work are avoided.

In one embodiment of the invention, the provision is made that several shutoff elements are associated with the air outlet opening. This embodiment makes it possible to provide a more accurate adaptation to the dimension of the glass sheet to be dried. This embodiment is preferably additionally characterized in that, with a shutoff element arranged at a spacing from the upper end of the air outlet opening and being in its operative position, also all of the shutoff elements located above this shutoff element are in their operative position.

Under practical conditions, the provision can be made that the shutoff element is disposed in the interior of the nozzle which latter is preferably substantially cylindrical, as known per se. This arrangement of the shutoff element does not interfere with the usual design of the drying zone of a sheet glass washing machine. In this connection, the additional provision can be made according to this invention that the shutoff element comprises a shutoff member which is preferably approximately cylindrical and can be placed from the inside against the air outlet opening. In this embodiment, the shutoff member of the shutoff element consists preferably of an elastically deformable material, for example foam rubber or an expanded synthetic resin.

In one embodiment of the nozzle according to this invention, the shutoff member of the shutoff element is coupled with a drive motor, e.g. a pressure medium motor arranged outside of the nozzle. This arrangement is advantageous because the drive motor for the shutoff element does not affect the design of the nozzle as such so that the latter can still be optimized with respect to the flow characteristic of the air conducted therethrough and flowing out of its air outlet opening.

The invention likewise extends to a device for the cleaning and drying of glass sheets, the drying zone of which contains at least one pair of mutually opposed nozzles in accordance with one of claims 1–9. This device is characterized in that the speed of the conveying means moving the glass sheet through the device is increased at least in the region of the drying zone in case of air outlet openings that are partially sealed off by the shutoff element, as compared with the conveying speed with completely opened air outlet openings.

Under practical conditions, increases in velocity by up to 40% can be achieved.

When raising the conveying speed of the glass sheets through the drying zone, the provision can also be made that the driving speed of the cleaning brushes, with air outlet openings partially blocked off by the shutoff element, and optionally the feed of cleaning fluid as well as in certain cases of rinsing fluid are increased as compared with the situation existing with completely opened air outlet openings.

The increase in speed provided with the use of the nozzle according to this invention in a cleaning system for glass sheets is possible without exerting a disadvantage on the drying effect, if a blower is provided which conveys filtered and optionally dried air to the nozzles, and if the output of the blower of conveyed air in case of partially blocked-off air outlet openings of the nozzle is unchanged.

Figure 2:
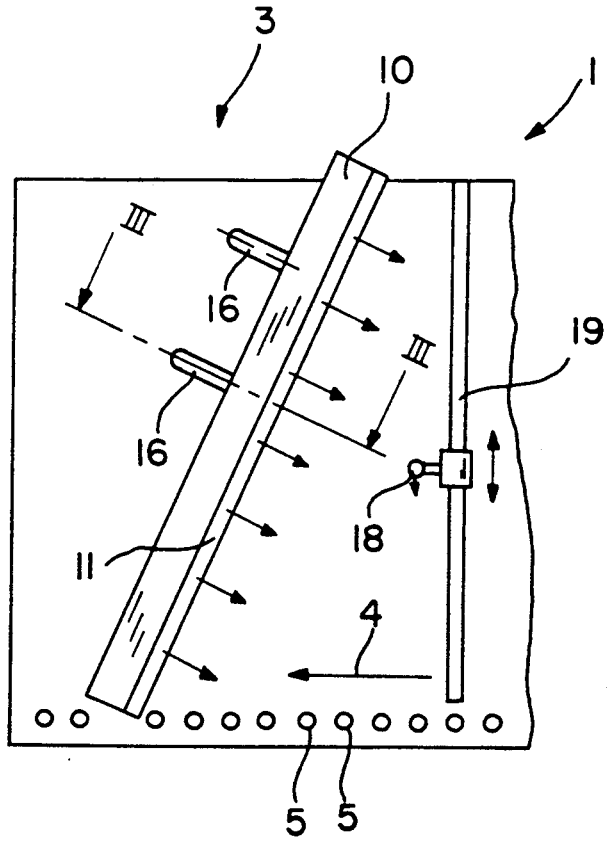
Figure 3:
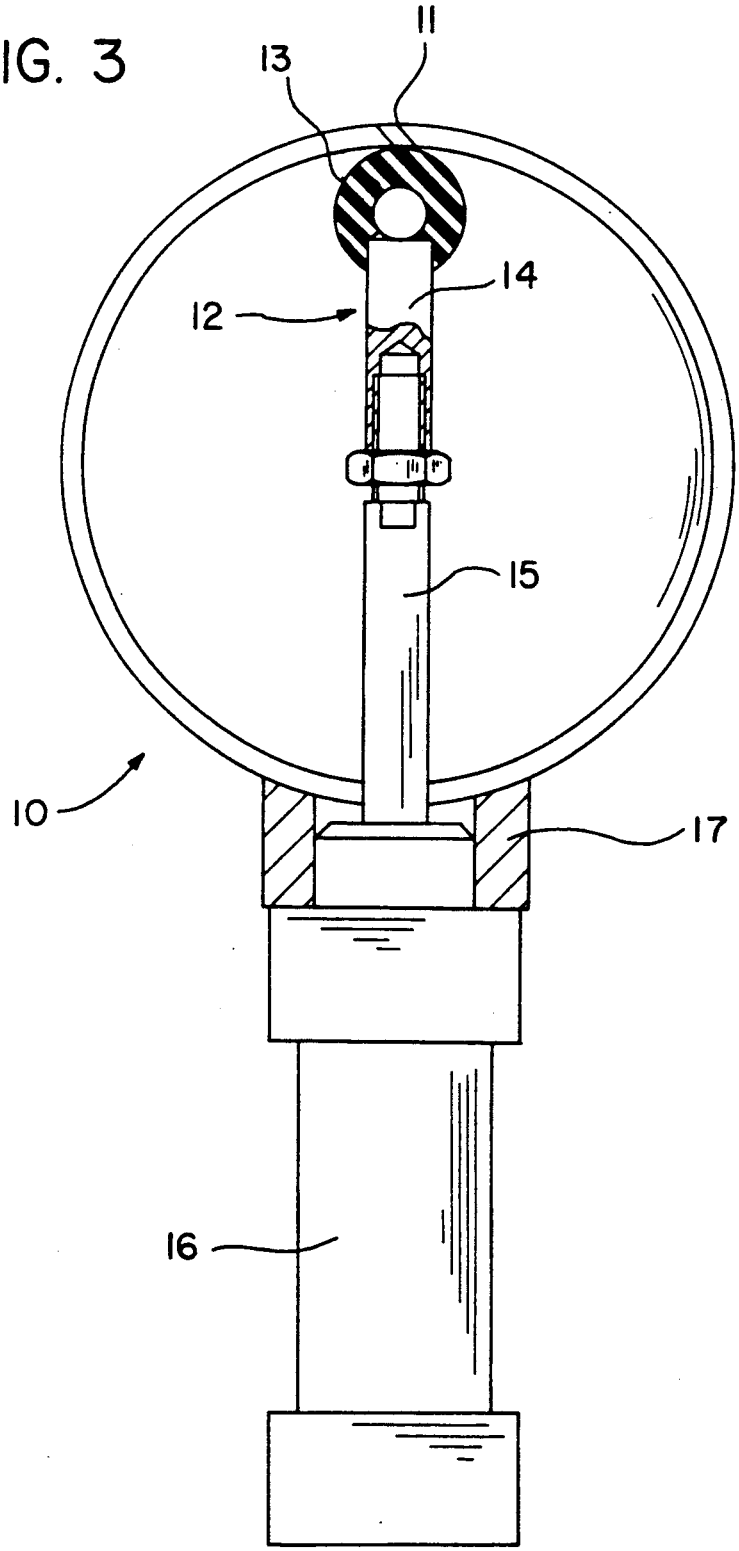

Additional details and features of the invention can be seen from the following description of embodiments illustrated in the drawings wherein:

FIG. 1 shows extensively schematized and in top view a sheet glass washing machine with drying zone, FIG. 2 shows a section along line II—II in FIG. 1, and FIG. 3 shows a section along line III—III in FIG. 2.

A device 1 shown in FIGS. 1 and 2 for the cleaning and drying of glass sheets is subdivided into a cleaning zone 2 and a drying zone 3. The glass sheets to be cleaned and to be dried are moved through the device 1 in the direction of arrow 4 on rollers 5 of a conveying means in upright condition. The conveying means can also be fashioned as disclosed and illustrated in EP-A-0,174,294.

In the embodiment illustrated, two pairs of round brushes 6 and 7 are shown in the cleaning zone 2; these brushes are driven rotationally about essentially vertical axes. Nozzles, not shown, for the delivery of cleaning and/or rinsing fluid are associated with the round brushes. Belt brushes can also be provided in place of the round brushes (compare EP-A-0,204,063).

Vertical drums 8 are arranged before and after, as well as between the round brushes 6 and 7, respectively; these drums are driven rotationally and support the conveyance of the glass sheets through the device 1 (these drums can be omitted if the conveyor is designed as described in EP-A-0,174,294).

Following the cleaning zone 2, the drying zone 3 is provided in the device 1, comprising two nozzles 10 extending, in an oblique orientation to the conveying direction 4, from the bottom toward the top in a plane in parallel to the conveying plane. The region covered by the nozzles 10 is, in the vertical direction, for example, 3 meters.

Each nozzle 10 of the mutually facing pair of nozzles 10 has an air outlet opening in the form of a longitudinal slot 11; air delivered to the nozzles 10 from a blower, not shown, via conduits, not shown, is blown out of this slot obliquely onto the glass sheet to be dried, the air flow being slanted in opposition to the direction of travel 4.

The device 1 furthermore comprises a housing 9 accommodating therein the cleaning zone 2 and the drying zone 3. The inlet and discharge apertures of the housing 9 can be designed as likewise disclosed in EP-A-0,174,294. Analogously, a partition equipped with a closing element known from EP-A-0,174,294 can be arranged between the two zones 2 and 3 of the device 1, namely the cleaning zone and the drying zone.

FIG. 3 shows a shutoff element 12 located in the interior of the nozzle 10. The shutoff element 12 has a shutoff member 13 connected via a mounting 14 by means of a threaded connection adjustably with the piston rod 15 of an operating cylinder 16, the latter being arranged outside of the nozzle 10 and being joined to the latter via a connecting piece 17.

The shutoff member 13 of the shutoff element 12 consists of an elastically yielding material and can be made, for example, of foam rubber (sponge rubber) or expanded synthetic resin, or it can also be constituted by an elastically resilient, pressurized hollow body.

By activation of the pressure medium cylinder 16, the shutoff member 13 of the shutoff element 12 can be retracted, from the operative position shown in FIG. 3 wherein it blocks off the air outlet opening 11 of the nozzle 10, into a rest position wherein it vacates the air outlet opening 11.

The feature of associating with the air outlet opening 11 of the nozzle 10 several shutoff elements 12 that can be operated independently of one another is within the scope of this invention. It is furthermore preferred that the shutoff elements are located in the upper region of the nozzle 10, i.e. in the region thereof which is remote from the conveying means 5.

When providing a shutoff element 12 with a continuously extending shutoff member 13 (it being possible to include also several pressure medium cylinders 16 for its operation), then it extends preferably over the upper half of the air outlet opening 11, so that when the shutoff element 12 is in its operative position, air can exit only from the bottom half of the nozzle 10; accordingly, only the most frequently occurring glass formats (height about 1.4–1.5 m) will be exposed to air for drying purposes.

When providing within the nozzle 10 several independently operable shutoff elements 12, then these are switched preferably in such a way that all shutoff elements 12 located above a shutoff element 12 in its operative position are likewise in a position wherein they seal off the air outlet opening 11. This ensures that no air will flow out of the nozzle 10 above the glass sheet to be dried.

In order to detect the height of the glass sheet to be dried and to correspondingly control the shutoff elements 12 or the shutoff element 12, a sensor 18 responsive to the top edge of a glass sheet can be displaceable upwardly and downwardly along a guide 19 in the device. The sensor 18 adjusts itself in correspondence with the vertical position of the top edge of the glass sheet and transmits a signal corresponding to its position to the control unit of the drive cylinders 16 for the shutoff elements 12 whereupon all shutoff elements 12 located in the region above the thus-determined level are closed.

In case the air outlet openings 11 of the nozzles 10 according to this invention are partially blocked off by placing shutoff elements 12 into their operative position, then it is advantageous not to reduce the output of the blower. Thereby, per unit time, a greater quantity of air will flow through the unblocked portion of the air outlet opening 11 of the nozzle 10 so that this air exits at a higher velocity and the drying effect is enhanced. This makes it possible to move a glass sheet more rapidly through the drying zone 3 than was previously the case when air flowed unused out of regions of the air outlet openings 11 lying above the top edge of the glass sheet.

The increase in velocity for moving the glass sheet in the direction of arrow 4 can likewise be controlled by the sensor 18 in dependence on the detected vertical position. In this context, increases in speed of up to 40% are possible in case the air outlet openings of the nozzles 10 are closed to the extent of one-half.

In order to adapt the efficiency of the cleaning zone 2 to the increased conveying speed in the region of the drying zone 3, the conveying speed can also be raised in this region, and, for example, the number of revolutions of the cleaning brushes 6 and 7 as well as of the conveying means 5, 8 can be increased to the above-cited extent from the presently customary 12 m/sec.

What is claimed is:

1. In a sheet glass washing machine (1) having conveying means (5) for conveying glass sheets successively through a washing zone (2) and a drying zone (3) and having in said drying zone a nozzle (10) having air outlet opening means (11) that extend upwardly in a direction away from said conveying means (5); the improvement comprising at least one shutoff element (12) for selectively shutting off a region of said opening means (11) located farthest from said conveying means (5), and means (16) for moving said at least one shutoff element (12) between positions in which it opens and closes said region.

2. Apparatus as claimed in claim 1, in which said shutoff element (12) extends over about half the length of the air outlet opening means (11).

3. Apparatus as claimed in claim 1, further comprising a sensor (18) that detects the height of the glass sheet to be dried and which transmits a corresponding signal to said moving means (16) to actuate said moving means to move said shutoff element to close off said opening means (11) above the detected height of the glass sheet.

4. Apparatus as claimed in claim 1, there being a plurality of said shutoff elements (12).

5. Apparatus as claimed in claim 4, in which all said shutoff elements above a closed shutoff element are also closed.

6. Apparatus as claimed in claim 1, in which said nozzle (11) is a substantially cylindrical conduit and said shutoff element (12) is disposed within the interior of the nozzle (11).

7. Apparatus as claimed in claim 6, in which said shutoff element (12) includes a part-cylindrical member (13) adapted to be positioned from inside the nozzle against the opening means (11).

8. Structure as claimed in claim 7, in which said part-cylindrical member (13) has an elastically deformable surface that contacts said opening means (11).

9. Apparatus as claimed in claim 1, in which said moving means (16) comprises a fluid-pressure motor disposed outside the nozzle (10).

10. Apparatus as claimed in claim 1, including means for increasing the speed of said conveying means (5) at least in the region of said drying zone (3) when said shutoff element (12) closes a portion of said opening means (11).

11. Apparatus as claimed in claim 10, including rotary cleaning brushes (6, 7) in said washing zone, and means for increasing the speed of rotation of said brushes when said shutoff element (12) closes a portion of said opening means (11).

12. Apparatus as claimed in claim 1, including means (16) for conveying air to said nozzle (10) the flow of air to the nozzle being the same whether said shutoff element (12) does or does not partially close said opening means (11).

* * * * *